US006629856B2

(12) United States Patent
Sawada et al.

(10) Patent No.: US 6,629,856 B2
(45) Date of Patent: Oct. 7, 2003

(54) PLATE CONNECTOR

(75) Inventors: Yoshitsugu Sawada, Shizuoka (JP); Takuya Hasegawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/961,188

(22) Filed: Sep. 24, 2001

(65) Prior Publication Data

US 2002/0037663 A1 Mar. 28, 2002

(30) Foreign Application Priority Data

Sep. 22, 2000 (JP) ..... 2000-289134

(51) Int. Cl.[7] ..... H01R 4/24
(52) U.S. Cl. ..... 439/404; 439/405
(58) Field of Search ..... 439/404, 397, 439/395, 854, 855, 744, 417, 418, 411, 412, 636, 862, 858; 200/51.02

(56) References Cited

U.S. PATENT DOCUMENTS 3,555,493 A * 1/1971 Baumanis ..... 339/176
3,720,907 A * 3/1973 Asick ..... 339/176
5,133,672 A * 7/1992 Nelligan et al. ..... 439/399
5,730,629 A * 3/1998 Samejima et al. ..... 439/855

FOREIGN PATENT DOCUMENTS

JP 11-54164 2/1999 ..... H01R/4/24

* cited by examiner

*Primary Examiner*—Alexander Gilman
(74) *Attorney, Agent, or Firm*—Sughrue Mion, PLLC

(57) ABSTRACT

A stacked plate connector (1) includes JB press-connecting terminals (50), and press-connecting plates (60). The JB press-connecting terminal (50) includes a wire connection portion (51), an electrical contact portion, and retaining piece portions (58), and has an L-shaped plan configuration. A wire (4) is press-connected to the wire connection portion (51). The retaining piece portions (58) project outwardly from outer surfaces (55*c*) of the wire connection portion (51). The press-connecting plate (60) includes a plate body (62). The plate body (62) includes a bottom wall (63*a*) and partition walls (63*b*). The partition walls (63*b*) extend upward from the bottom wall (63*a*). The JB press-connecting terminal (50) is attached to the press-connecting plate (60), with the retaining piece portions (58) retainingly engaged with inner surfaces (63*c*) of the partition walls (63*b*).

8 Claims, 7 Drawing Sheets

PLATE CONNECTOR

BACKGROUND OF THE INVENTION

1. Field of the Invention

The present invention relates to a plate connector comprising press-connecting terminals and plate-like insulating members to which these press-connecting terminals are attached.

The present application is based on Japanese Patent Application No. 2000-289134, which is incorporated herein by reference.

2. Description of the Related Art

A wire harness to be mounted on an automobile or the like is divided into a plurality of sub-harnesses corresponding respectively to functions of electronic equipments, and these sub-harnesses can be connected together. Therefore, the connection between wires of the sub-harnesses is complicated, and the efficiency of the assembling operation is lowered, and in the worst case, the stable quality is not obtained.

Therefore, in order to facilitate the connection between the wires, there has been proposed a plate connector comprising a plurality of plate-like insulating members stacked together, and press-connecting terminals attached to the plate-like insulating members.

The plate-like insulating member includes a flat plate-like bottom wall, and a plurality of partition walls extending upward from this bottom wall. The plurality of partition walls are arranged at equal intervals in parallel relation to one another. Any adjacent two of these partition walls jointly form a wire receiving groove for receiving a wire.

The press-connecting terminal includes a wire connection portion for connection to the wire, and an electrical contact portion of a tubular shape extending from the wire connection portion. The wire connection portion includes pairs of opposed press-connecting blades for being press-connected to the wire. In the press-connecting terminal, the wire connection portion and the electrical contact portion are arranged to assume an L-shaped plan configuration (that is, assume an L-shape when seen from above).

In the plate-like insulating member, the press-connecting terminals are arranged on the bottom wall in two directions, that is, in the longitudinal direction of the wire receiving grooves and in the direction of juxtaposition of the wire receiving grooves. Namely, the press-connecting terminals are arranged on the bottom wall in a two-dimensional matrix manner. A plurality of plate-like insulating members, each having the press-connecting terminals arranged in a two-dimensional matrix manner, are stacked one upon another, and an electrically-conductive connection bar is inserted in the desired electrical contact portions superposed together. By doing so, the plate connector is obtained.

Thus, in the plate connector, the press-connecting terminals for being press-connected to the wires are mounted in desired positions on the bottom wall of each plate-like insulating member, and the connection bars are inserted in the desired electrical contact portions, so that the wires are interconnected according to a predetermined pattern.

For assembling the above plate connector, first, the press-connecting terminals are mounted in desired positions on the bottom wall of each plate-like insulating member. Then, the wires are press-connected to the press-connecting terminals attached to the plate-like insulating member. The plate-like insulating members are stacked one upon another, and the connection bars are inserted in the desired positions.

Therefore, when press-connecting the wire to the press-connecting terminal, it is necessary to highly precisely position the press-connecting terminal particularly in the width direction of the wire receiving groove and therefore in the width direction of the wire. When the press-connecting terminal is displaced in the width direction of the wire receiving groove, there is a possibility that a distal end of a blade member, used in the press-connecting operation, is brought into contact with the press-connecting blades, and as a result the blade member is worn, and the press-connecting blades are broken.

When the press-connecting blades are broken, there is a possibility that the wire fails to be electrically connected to the press-connecting terminal. And besides, when the press-connecting terminal is displaced in the width direction of the wire receiving groove, there is a possibility that a conductor of the wire to be press-connected to the wire connection portion, is severed by the press-connecting blades.

SUMMARY OF THE INVENTION

It is therefore an object of the present invention to provide a plate connector in which each press-connecting terminal, having a wire connection portion and an electrical contact portion disposed at a position assuming an L-shaped plan configuration, can be highly precisely positioned in a width direction of a wire press-connected to the press-connecting terminal.

According to a first aspect of the present invention, there is provided a plate connector which comprises a press-connecting terminal including a wire connection portion to which a wire is connectable, and an electrical contact portion, in which an insertion member connectable to another metal terminal is insertable, extending from the wire connection portion, wherein the wire connection portion and the electrical contact portion are disposed at a position assuming an L-shaped plan configuration in the press-connecting terminal; a plate-like insulating member, in which the press-connecting terminal is receivable, having a wall on which the press-connecting terminal is to be placed; and a retaining portion disposed on the press-connecting terminal, the retaining portion being retained with the plate-like insulating member when the press-connecting terminal is received in the plate-like insulating member, wherein the press-connecting terminal is moved toward the wall of the plate-like insulating member in a direction in which the wire is inserted in the wire connection portion of the press-connecting terminal, and is attached to the plate-like insulating member. Accordingly, the press-connecting terminal can be more precisely positioned in the width direction of the wire as compared with the case where the press-connecting terminal is moved in the width direction of the wire and also along the wall, and is attached to the plate-like insulating member.

The press-connecting direction (i.e., inserting direction) of the wire to the wire connection portion coincides with the attaching direction of the press-connecting terminal to the plate-like insulating member. Therefore, even when the retaining portions are incompletely retained relative to the plate-like insulating member, the press-connecting terminal is pressed toward the wall to bring the retaining portions in the completely-retained condition simultaneously when the wire is press-connected to the wire connection portion.

According to a second aspect of the present invention, it is preferable that the plate-like insulating member includes a plurality of partition walls extending upward from the wall, and the retaining portion includes a plurality of retaining piece portions, which respectively project outwardly from a pair of parallel outer surfaces of the wire connection portion, and which are resiliently deformable so that projecting amounts of the retaining piece portions from the outer surfaces of the wire connection portion are varied, wherein when the press-connecting terminal is attached to the plate-like insulating member so that the press-connecting terminal is inserted between the partition walls adjacent to each other, the retaining piece portions are retainingly engaged, at distal ends thereof disposed remote from the outer surfaces of the wire connection portion, with inner surfaces of the corresponding partition walls, and outwardly presses the inner surfaces of the partition walls by respective resilient restoring forces of the retaining piece portions. As described, when the press-connecting terminal is inserted between the adjacent partition walls, and is attached to the plate-like insulating member, the retaining piece portions produce resilient restoring forces which outwardly press the inner surfaces of the partition walls. Accordingly, the wire connection portion, that is, the press-connecting terminal, is positively positioned at a middle point between the partition walls in the width direction of the wire to be press-connected.

According to a third aspect of the present invention, it is preferable that, when the press-connecting terminal is attached to the plate-like insulating member, the retaining piece portions, projecting respectively from the pair of outer surfaces of the wire connection portion, are inclined relative to an attaching direction of the press-connecting terminal to the plate-like insulating member such that a distance between the retaining piece portions is increased gradually in a direction away from the wall of the plate-like insulating member. Accordingly, when the press-connecting terminal, attached to the plate-like insulating member, tends to move in the direction away from the wall, the retaining piece portions are positively retained by the inner surfaces of the partition walls.

According to a fourth aspect of the present invention, it is preferable that the plate-like insulating member has convex portions projecting from inner surfaces of adjacent two of the partition walls toward each other, and wherein when the press-connecting terminal is attached to the plate-like insulating member, the convex portions are remoter from the wall of the plate-like insulating member than the retaining piece portions are. Accordingly, when the press-connecting terminal, attached to the plate-like insulating member, tends to be withdrawn from the space between the partition walls after the retaining piece portions are completely retained relative to the inner surfaces of the partition walls, each retaining piece portion strikes against (interferes with) the corresponding convex portion.

BRIEF DESCRIPTION OF THE DRAWINGS

The above and other objects and advantages of the present invention will become more apparent by describing in detail a preferred embodiment thereof with reference to the accompanying drawings, wherein.

DETAILED DESCRIPTION OF THE PREFERRED EMBODIMENT

Figure 2:
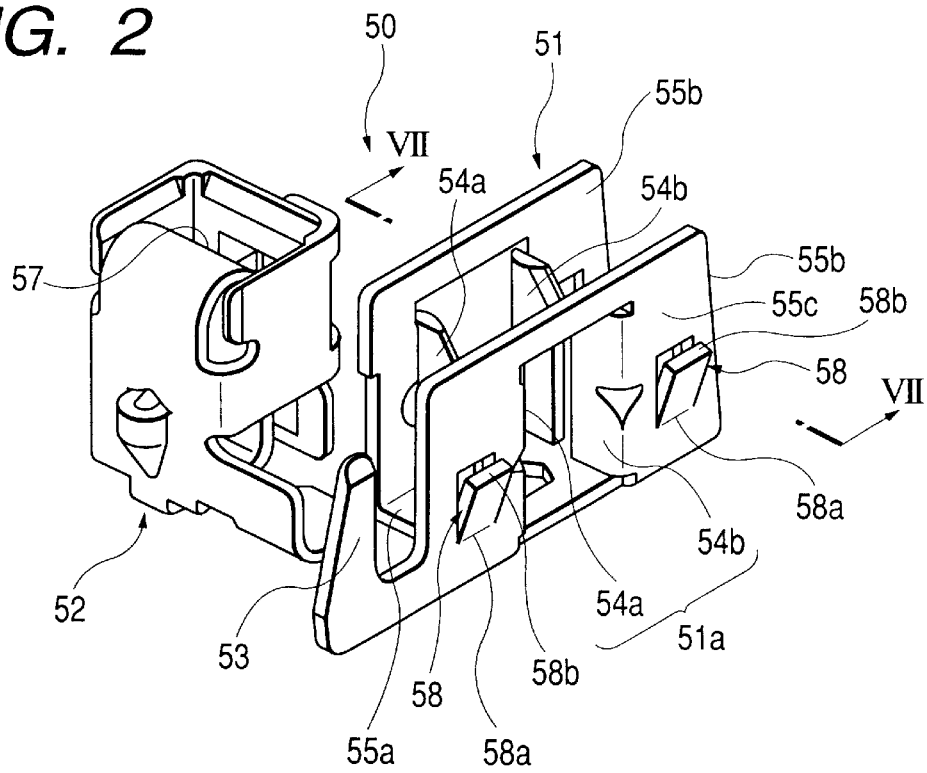
FIG. 2 is a perspective view of a JB (i.e., junction block) press-connecting terminal used in the stacked plate connector of the above embodiment.
Figure 3:
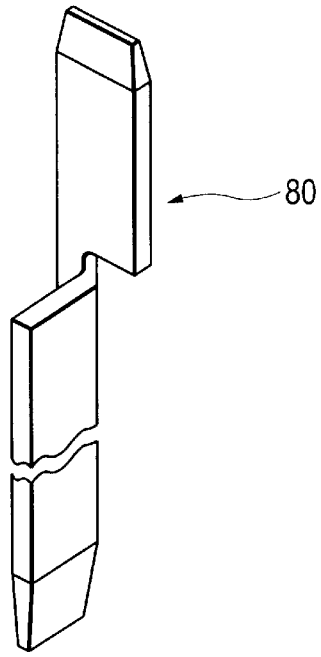
FIG. 3 is a perspective view of a connection bar used in the stacked plate connector of the above embodiment.
Figure 4:
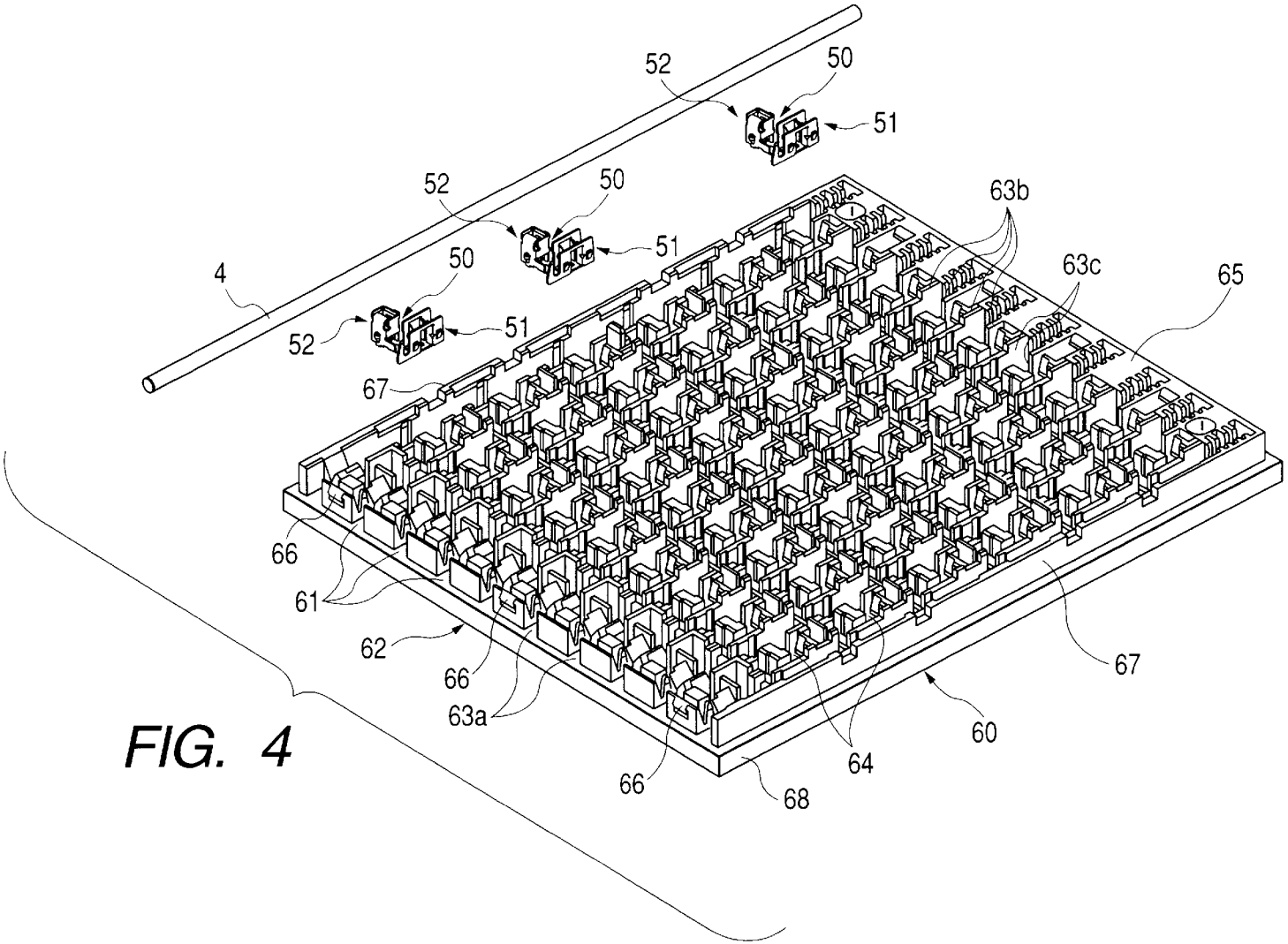
FIG. 4 is a perspective view showing a press-connecting plate of the stacked plate connector.

One preferred embodiment of a plate connector (stacked plate connector) 1 of the present invention will now be described with reference to FIGS. 1 to 10. The plate connector (stacked plate connector) 1 of this embodiment, shown in FIG. 1, comprises JB (i.e., junction block) press-connecting terminals 50 (as shown in FIG. 2), and press-connecting plates (plate-like insulating members) 60 (as shown in FIG. 4) each having the JB press-connecting terminals 50 attached thereto. A plurality of press-connecting plates 60, each having the JB press-connecting terminals 50 attached thereto, are stacked one upon another to form the stacked plate connector 1.

Figure 1:
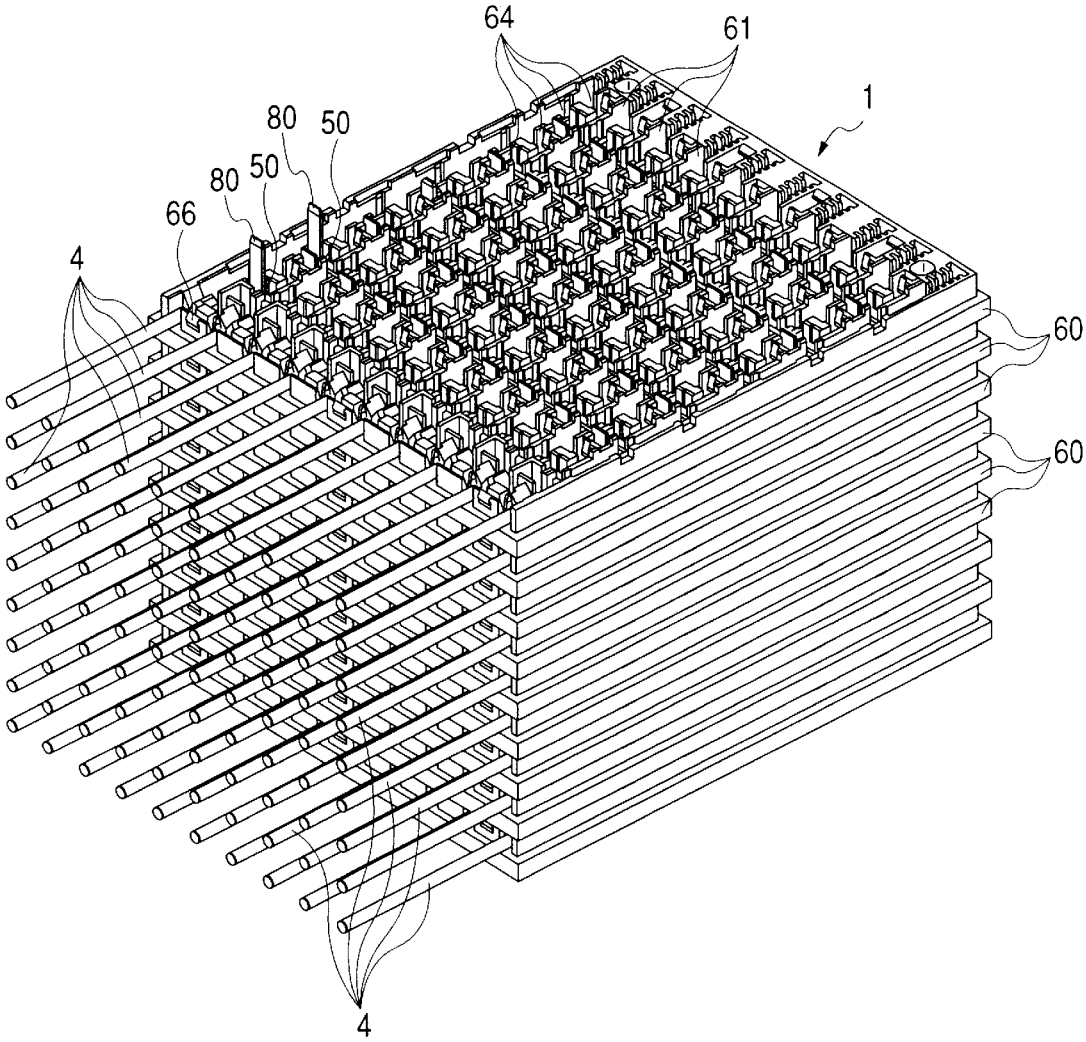
FIG. 1 is a perspective view showing one preferred embodiment of a stacked plate connector of the present invention.

A wire 4 (as shown in FIG. 1) is press-connected to the JB press-connecting terminal 50. The stacked plate connector 1 electrically interconnects the wires 4, press-connected to the JB press-connecting terminals 50, according to a predetermined pattern.

The JB press-connecting terminal 50 is formed, for example, by bending an electrically-conductive metal sheet or the like. As shown in FIGS. 2 to 7, the JB press-connecting terminal 50 includes a wire connection portion 51 for connection to the wire 4, an electrical contact portion 52, and a plurality of retaining piece portions (retaining portions) 58. The wire connection portion 51 includes a flat mounting wall 55*a*, on which the wire 4 is placed, a pair of side walls 55*b*, a press-deforming piece portion 53, and a press-connecting portion 51*a*.

The mounting wall 55*a* has a strip-like shape. Each of the pair of side walls 55*b* has a strip-like shape. The pair of side walls 55*b* extend respectively from opposite side edges of the mounting wall 55*a* spaced from each other in a direction of the width thereof. The pair of side walls 55*b* extend upward from the mounting wall 55*a*.

The press-deforming piece portion 53 is disposed in upstanding relation to the mounting wall 55*a*, and is continuous with the mounting wall 55*a*. The press-deforming piece portion 53 is bent generally in overlying relation to the mounting wall 55*a*, and cooperates with this mounting wall 55*a* to hold the wire 4 therebetween. Namely, the wire 4 is press-fastened to the mounting wall 55*a* by the press-deforming piece portion 53.

The press-connecting portion 51*a* includes two pairs of opposed press-connecting blades 54*a* and 54*b*. The press-connecting blades 54*a* and 54*b* are disposed in upstanding relation to the mounting wall 55*a*. Each pair of press-connecting blades 54*a*, 54*b* extend respectively from the inner surfaces of the opposed side walls 55*b* toward each other.

The wire 4 is press-fitted into the space between each pair of press-connecting blades 54*a*, 54*b*, and these press-connecting blades cut a sheath 4*a* (shown in FIGS. 8 to 10) of the wire 4 to contact a conductor 4*b* (shown in FIGS. 8 to 10), so that the press-connecting blades are electrically connected to the wire 4. Namely, these press-connecting blades are press-connected to the wire 4. The wire 4 is press-fitted into the space between each pair of press-connecting blades 54*a*, 54*b* in a direction of arrow S2 shown in FIGS. 8 to 10. The arrow S2 is directed toward the mounting wall 55*a*, and perpendicularly intersects the surface of the mounting wall 55*a*.

The electrical contact portion 52 is continuous with one widthwise side edge of the mounting wall 55*a*. Namely, the electrical contact portion 52 is continuous with the wire connection portion 51. The electrical contact portion 52 and the wire connection portion 51 are disposed at a position assuming an L-shaped plan configuration (that is, an L-shape when seen from above) of the JB press-connecting terminal 50. The electrical contact portion 52 is disposed generally perpendicularly to the wire connection portion 51 in offset relation to the longitudinal axis of the wire 4 placed on the mounting wall 55*a*.

The electrical contact portion 52 is formed into a square tubular shape. The electrical contact portion 52 is arranged, with its tubular hole communicating with a communication hole 70 in the press-connecting plate 60. A connection bar (insertion member) 80, as shown in FIG. 3, is inserted in the tubular hole in the electrical contact portion 52. The connection bar 80 is made of electrically-conductive metal, and has a strip-like shape. A connection spring piece portion 57 is provided within the tubular hole in the electrical connection portion 52. The connection spring piece portion 57 electrically connects the electrical contact portion 52 to the connection bar 80.

When the press-connecting plates 60 are stacked together, the superposed JB press-connecting terminals 50 are electrically connected together by the connection bar 80 inserted in their electrical contact portions 52. Thus, the electrical contact portion 52 connects the JB press-connecting terminal to the other JB press-connecting terminals (metal terminals).

Figure 7:
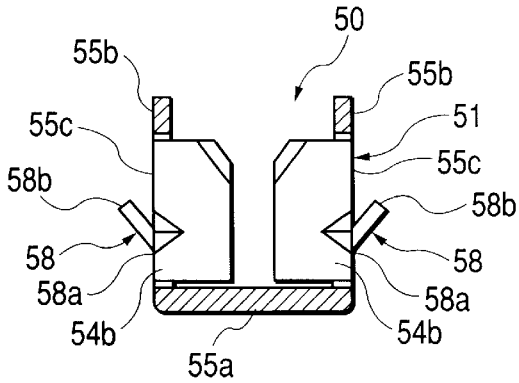
FIG. 7 is a cross-sectional view taken along the line VII—VII of FIG. 2.

The retaining piece portions 58 are formed by stamping predetermined portions of the side walls 55*b*. One of the retaining piece portions 58 is formed on the side wall 55*b* disposed close to the electrical contact portion 52 while the other two retaining piece portions 58 are formed on the side wall 55 disposed remote from the electrical contact portion 52. As shown in FIGS. 2 and 7, each retaining piece portion 58 extends at one end 58*a* thereof from the side wall 55*b*, and the distal end 58*b* thereof is spaced from the side wall 55*b*. Each retaining piece portion 58 is projected outwardly from an outer surface 55*c* of the sidewall 55*b*. The distal ends 58*b* of the retaining piece portions 58 are especially projected outwardly from the outer surfaces 55*c* of the side walls 55*b*.

The retaining piece portion 58, formed on the side wall 55*b* disposed close to the electrical contact portion 52, and one of the retaining piece portions 58, formed on the side wall 55*b* disposed remote from the electrical contact portion 52, are disposed in opposed relation to each other, with the wire 4 (press-connected to the wire connection portion 51) interposed therebetween. Namely, these retaining piece portions 58 are disposed symmetrically with respect to the axis of the wire 4.

As shown in FIG. 7, the retaining piece portion 58 is inclined with respect to the press-connecting direction S2 of the wire 4 to the press-connecting portion 51*a* in such a manner that the distance of this retaining piece portion 58 from the outer surface 55*c* is increasing gradually from the one end 58*a* thereof toward the distal end 58*b* thereof.

Namely, when the JB press-connecting terminal 50 is attached to the press-connecting plate 60, the retaining piece portions 58, disposed symmetrically with respect to the axis of the wire 4, are inclined relative to an attaching direction S1 of the JB press-connecting terminal 50 to the press-connecting plate 60 in such a manner that the distance between these retaining piece portions 58 is increasing gradually in a direction away from a bottom wall 63*a* (described later).

The outer surfaces 55*c* of the pair of side walls 55*b* define the pair of parallel outer surfaces of the electrical connection portion 52 (recited in this specification), respectively. The distal end 58*b* is the end remote from the outer surface 55*c* (recited in the specification).

The retaining piece portion 58 can be resiliently deformed so that the distal end 58*b* can be moved toward and away from the outer surface 55*c*. Namely, the retaining piece portions 58 are resiliently deformable so that the projecting amounts of the distal ends 58*b* from the outer surfaces 55*c* are variable. When the JB press-connecting terminal 50 is attached to the press-connecting plate 60, the retaining piece portion 58 can be retained by an inner surface 63*c* of a partition wall 63*b* (described later).

Figure 9:
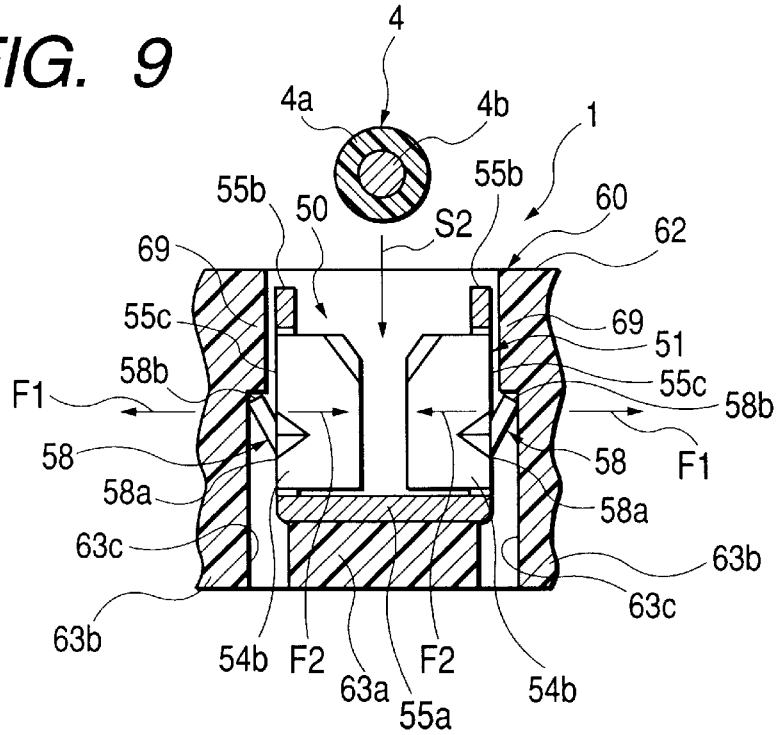
FIG. 9 is an explanatory view a condition in which the JB press-connecting terminal of FIG. 2 is attached to the press-connecting plate of FIG. 4 in a completely-retained condition of retaining piece portions.

When the JB press-connecting terminal 50 is attached to the press-connecting plate 60, the retaining piece portion 58 produces a resilient restoring force which presses the inner surface 63*c* of the partition wall 63*b* toward the outer side of a wire receiving grove 61, that is, in a direction of arrow F1 in FIG. 9. In this manner, the retaining piece portion 58 is retained by the inner surface 63*c* of the partition wall 63*b*, and therefore is retained by the press-connecting plate 60.

The wire connection portion 51 of the JB press-connecting terminal 50 is received in a groove main portion 61*a* of the wire receiving groove 61 (described later) in the press-connecting plate 60, and the electrical contact portion 52 is received in a receiving portion 64 (described later) of the wire receiving groove 61. The JB press-connecting terminal 50 is press-fitted into the groove main portion 61*a* and the receiving portion 64 in such a direction that the distance between the distal ends 58*b* of the retaining piece portions 58, disposed symmetrically with respect to the axis of the wire 4, is reduced. When the JB press-connecting terminal 50 is thus press-fitted into the groove main portion 61*a* and the receiving portion 64, this terminal is received in (or held in or attached to) the press-connecting plate 60.

The press-connecting plate 60 is made of an insulative synthetic resin or the like, and has a plate-like or flat plate-like shape. As shown in FIGS. 1 and 4 to 6, the press-connecting plate 60 includes a rectangular plate body 62, the plurality of wire receiving grooves 61, and the communication holes 70 (shown in FIG. 6). The plate body 62 includes the substantially flat bottom wall 63*a*, a rear wall 65, a pair of side walls 67, the plurality of partition walls 63*b* extending upward from the bottom wall 63*a*, and a flange portion 68.

The rear wall 65 is continuous with one edge (disposed at the right in the drawings) of the bottom wall 63*a*. The rear wall 65 extends upward from the bottom wall 63*a*. The pair of side walls 67 are continuous with opposite side edges of the bottom wall 63*a*, respectively, and are continuous with the rear wall 65. The pair of side walls 67 extend upward from the bottom wall 63*a*. The pair of side walls 67 are parallel to each other.

The partition walls 63*b* are parallel to one another, and are spaced from one another. The partition walls 63*b* are parallel to the pair of side walls 67. The partition walls 63*b* extend in the longitudinal direction of the plate body 62.

The flange portion 68 projects outwardly from the peripheral edge of the bottom wall 63*a* of the plate body 62. The flange portion 68 projects outwardly beyond the outer surfaces of the rear wall 65 and the side walls 67. The flange portion 68 is formed on the bottom wall 63*a* over the entire periphery thereof. The flange portion 68 increases the rigidity of the bottom wall 63*a* and hence the rigidity of the plate body 62, thereby preventing the bottom wall 63*a* and hence the plate body 62 from being curved or warped.

Figure 6:
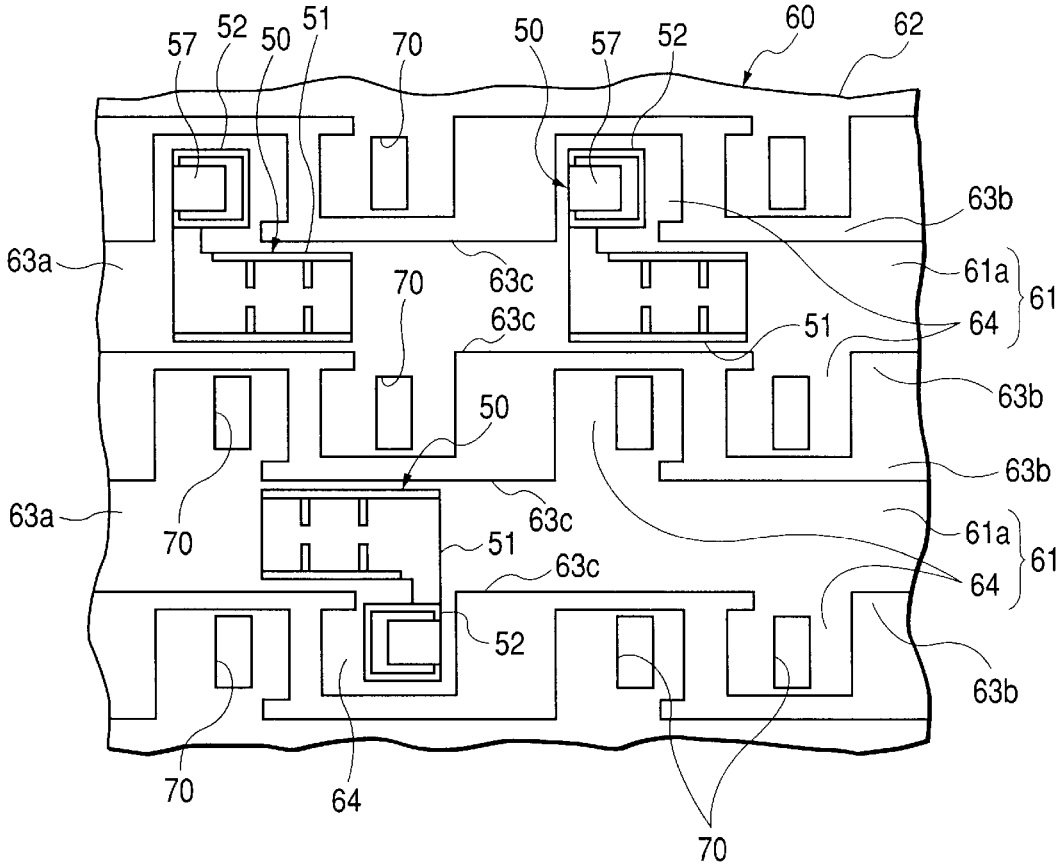
FIG. 6 is a plan view showing the press-connecting plate of FIG. 4 to which the JB press-connecting terminals of FIG. 2 are attached.

The wire receiving groove 61 is formed by the two adjacent partition walls 63*b* and the bottom wall 63*a*. As shown in FIG. 6, the wire receiving groove 61 includes the groove main portion 61*a*, and the receiving portions 64. The groove main portion 61*a* is formed by the inner surfaces 63*c* of the two adjacent partition walls 63*b* and the surface of the bottom wall 63*a*. The groove main portion 61*a* extends along the side walls 67 and the partition walls 63*b*. The groove main portion 61*a* receives the wire connection portions 51 of the JB press-connecting terminals 50.

The receiving portions 64 are formed in recessed relation to the partition wall 63*b* so as to increase the distance between the two adjacent partition walls 63*b*. The receiving portions 64 are formed in the two adjacent partition walls 63*b* forming one wire receiving groove 61 therebetween. The receiving portions 64, formed in one of the two adjacent partition walls 63*b*, and the receiving portions 64, formed in the other partition wall 63*b*, are arranged alternately in the longitudinal direction of the groove main portion 61*a*.

Thus, the plurality of receiving portions 64 are arranged in a juxtaposed manner in the longitudinal direction of the groove main portion 61*a* of the wire receiving groove 61. The receiving portion 64 receives the electrical contact portion 52 of the JB press-connecting terminal 50 therein. The communication hole 70 is formed in each of the receiving portions 64. The communication holes 70 extend through the bottom wall 63*a* of the plate body 62.

Figure 8:
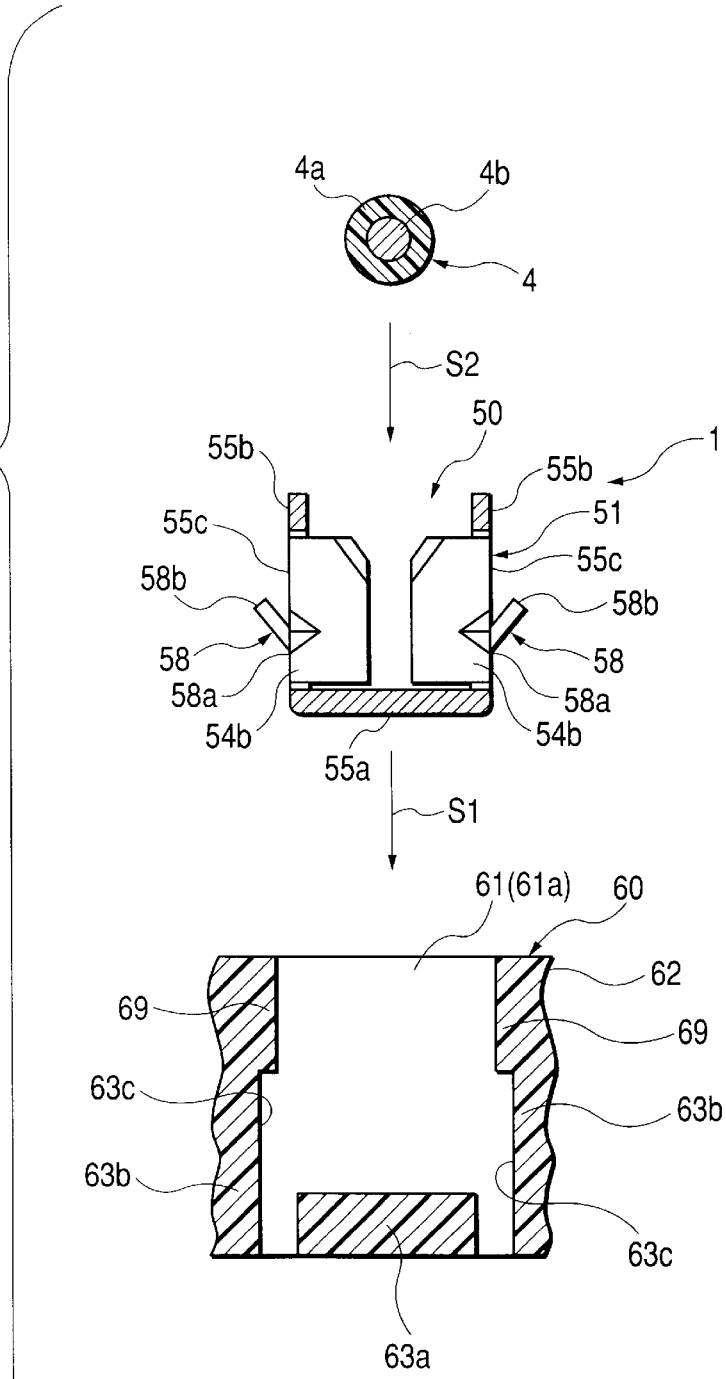
FIG. 8 is an explanatory view schematically showing the process of attaching the JB press-connecting terminal of FIG. 2 to the press-connecting plate of FIG. 4.
Figure 10:
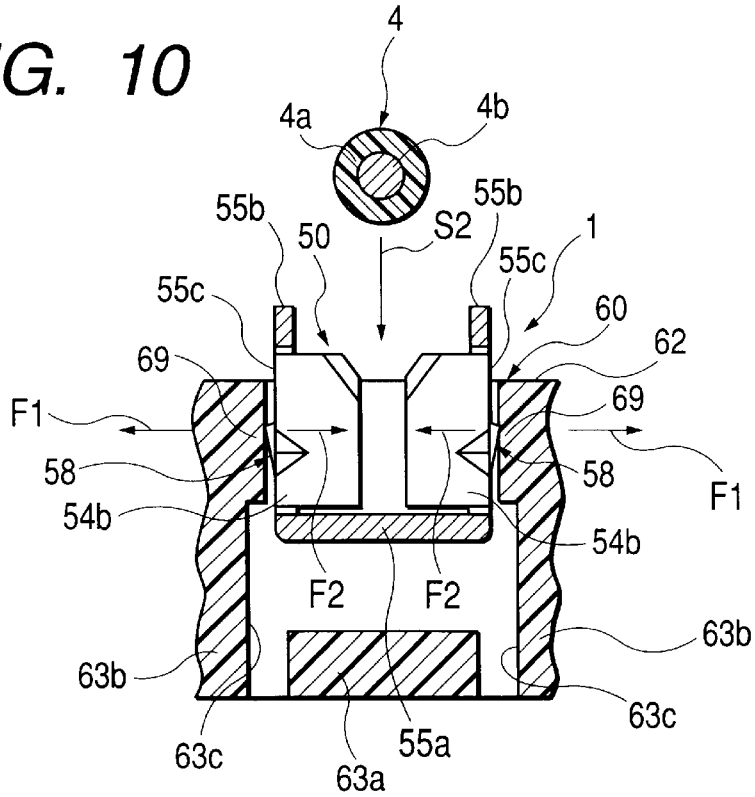
FIG. 10 is an explanatory view a condition in which the JB press-connecting terminal of FIG. 2 is attached to the press-connecting plate of FIG. 4 in an incompletely-retained condition of the retaining piece portions.

As shown in FIGS. 8 to 10, convex portions 69 are formed on any two adjacent partition walls 63*b*, respectively. The convex portion 69 projects from the inner surface 63*c* toward the inside of the wire receiving groove 61. Namely, the convex portions 69 project from the opposed partition walls 63*b* toward each other. The convex portion 69 is formed at an edge portion of the partition wall 63*b* remote from the bottom wall 63*a*. The convex portion 69 is provided between the adjacent receiving portions 64 spaced from each other in the longitudinal direction of the groove main portion 61*a* of the wire receiving groove 61. With this construction, when the press-connecting terminal 50 is mounted in the wire receiving groove 61, the convex portion 69 is remoter from the bottom wall 63*a* than the retaining piece portion 58 is.

The press-connecting plate 60 includes a plurality of retaining projections 66 and a plurality of retaining reception projections. The retaining projections 66 can be retainingly engaged with the corresponding retaining reception projections, respectively. When forming the stacked plate connector 1, the retaining projections 66 are retainingly engaged with the corresponding retaining reception projections, respectively, thereby fixing the press-connecting plates 60 to one another.

The JB press-connecting terminals 50 are arranged on the bottom wall 63*a* of the press-connecting plate 60 in two directions, that is, in the longitudinal direction of the groove main portions 61*a* of the wire receiving grooves 61 and in the direction of juxtaposition of these wire receiving grooves 61. Namely, the JB press-connecting terminals 50 are arranged on the bottom wall 63*a* of the press-connecting plate 60 in a two-dimensional matrix manner.

For assembling the stacked plate connector 1, first, the JB press-connecting terminals 50 are attached to each press-connecting plate 60. At this time, the JB press-connecting terminal 50 is moved toward the bottom wall 63*a* in the direction of arrow S1, and is attached to the plate body 62. The arrow S1 is directed toward the bottom wall 63*a*, and perpendicularly intersects the surface of the bottom wall 63*a*.

When the JB press-connecting terminals 50 are attached to, the plate body 62 and hence the press-connecting plate 60, the retaining piece portions 58 of each of these terminals are either in a completely-retained condition (shown in FIG. 9) or in an incompletely-retained condition (shown in FIG. 10). In the completely-retained condition shown in FIG. 9, the mounting wall 55*a* is superposed on the bottom wall 63, and the retaining piece portions 58 are retained by the inner surfaces 63*c* of the partition walls 63*b*.

The retaining piece portion 58 produces a resilient restoring force which is exerted in the direction of arrow F1 (in FIG. 9), and presses the partition wall 63*b* toward the outer side of the wire receiving grove 61. Reaction forces of the above resilient restoring forces, each exerted in a direction of arrow F2 (in FIG. 9) opposite to the direction of arrow F1, act on the JB press-connecting terminal 50. The JB press-connecting terminal 50 is positioned at a middle point between the partition walls 63*b*.

In the incompletely-retained condition shown in FIG. 10, the bottom wall 63*a* and the mounting wall 55*a* are disposed in spaced, opposed relation to each other, and the retaining piece portions 58 are retainingly engaged with the inner surfaces of the convex portions 69. The retaining piece portion 58 produces a resilient restoring force which is exerted in the direction of arrow F1 (in FIG. 10), and presses the partition wall 63*b* toward the outer side of the wire receiving grove 61. Reaction forces of the above resilient restoring forces, each exerted in a direction of arrow F2 (in FIG. 10) opposite to the direction of arrow F1, act on the JB press-connecting terminal 50. The JB press-connecting terminal 50 is positioned at the middle point between the partition walls 63*b*.

The JB press-connecting terminal 50 is thus received in the wire receiving groove 61 as shown in FIG. 6. Then, the wire 4 is press-connected to the JB press-connecting terminal 50, received in the groove main portion 61*a* and the receiving portion 64. At this time, the wire 4 is press-fitted in the space between each pair of press-connecting blades 54*a*, 54*b* of the wire connection portion 51 in the direction of arrow S2 in FIGS. 8 to 10.

When the wire 4 is press-connected in the direction of arrow S2 in the incompletely-retained condition (shown in FIG. 10) of the retaining piece portions 58, the JB press-connecting terminal 50 is pressed toward the bottom wall 63*a*. As a result, the JB press-connecting terminal 50 is brought into a completely-retained condition, with the retaining piece portions 58 retained by the inner surfaces 63*c* of the partition walls 63*b,* as shown in FIG. 9.

Figure 5:
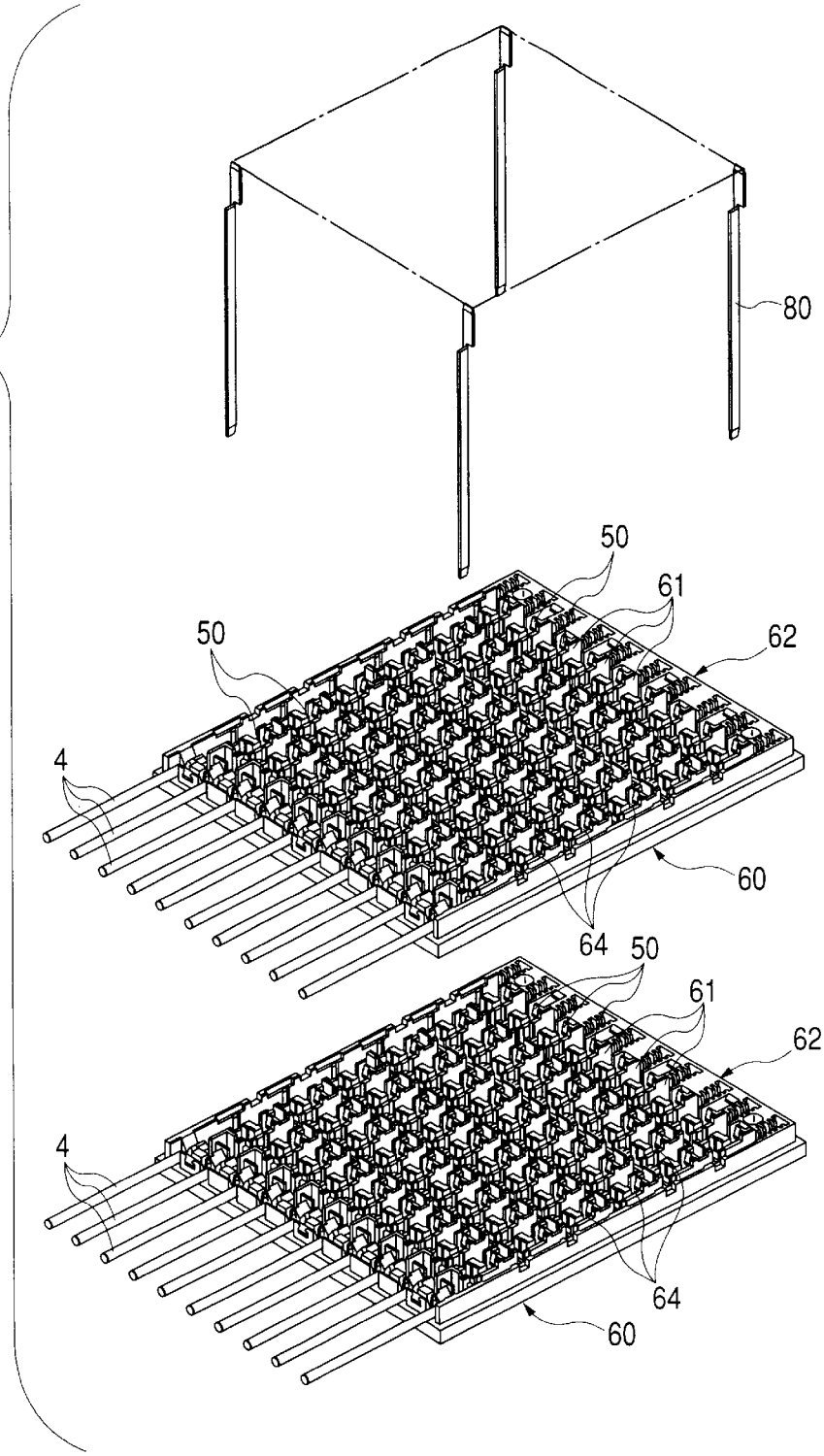
FIG. 5 is a perspective view showing the press-connecting plates of FIG. 4 superposed together in parallel, spaced relation to each other.

In this condition, the press-connecting plates 60 are superposed together, with the plate bodies 62 disposed in parallel, spaced relation to each other, as shown in FIG. 5. Then, any two adjacent press-connecting plates 60 are moved toward each other, so that the retaining projections 66 are retainingly engaged with the corresponding retaining reception projections, respectively, thereby fixing the press-connecting plates to each other. Each connection bar 80 is inserted and passed through the predetermined communication holes 70 and electrical contact portions 52, thereby forming the stacked plate connector 1 as shown in FIG. 1.

The positions of mounting of the JB press-connecting terminals 50 on the bottom wall 63*a* and the positions of insertion of the connection bars 80 are selected, and by doing so, the stacked plate connector 1 can interconnect the wires 4, press-connected to the JB press-connecting terminals 50, according to a predetermined pattern. The stacked plate connector 1, when mounted within an electric connection box having, for example, relays and fuses mounted thereon, connect the wires 4 to these relays and fuses according to a predetermined pattern.

In this embodiment, the JB press-connecting terminal 50 is moved toward the bottom wall 63*a* in the press-connecting direction S2 of the wire 4 to the wire connection portion 52, and is attached to the press-connecting plate 60. Therefore, the position of the JB press-connecting terminal 50 in the width direction of the wire receiving groove 61, that is, in the width direction of the wire 4, can be kept highly precisely as compared with the case where the JB press-connecting terminal 50 is moved in the width direction of the wire 4 (to be press-connected to this terminal) and also along the bottom wall 63*a,* and is attached to the press-connecting plate 60.

Therefore, when press-connecting the wire 4 to the JB press-connecting terminal 50, wear of a blade member, used in this press-connecting operation, is prevented, and the incomplete press-connection and the cutting of the conductor 4*b* can be prevented. Therefore, the wire 4 can be positively press-connected to the JB press-connecting terminal 50.

The attaching direction S1 of the JB press-connecting terminal 50 to the press-connecting plate 60 coincides with the press-connecting direction S2 of the wire to the wire connection portion 52, and therefore even when the retaining piece portions 58 are incompletely retained relative to the press-connecting plate 60, the JB press-connecting terminal 50 can be pressed toward the bottom wall 63*a* simultaneously when the wire 4 is press-connected to the wire connection portion 52. Therefore, simultaneously when the wire 4 is press-connected to the JB press-connecting terminal 50, the retaining piece portions 58 can be completely retained, thus attaching the JB press-connecting terminal 50 to the press-connecting plate 60.

Therefore, the stacked plate connector 1 can be assembled without the need for confirming whether or not the retaining piece portions 58 are completely retained when the JB press-connecting terminal 50 is attached to the press-connecting plate 60. Therefore, the time and labor, required for assembling the stacked plate connector 1, can be save.

Each of the retaining piece portions 58 presses the partition wall 63*b* of the press-connecting plate 60 outwardly, and the reaction forces, each exerted in the direction of arrow F2 (in FIG. 9), act on the JB press-connecting terminal 50. Therefore, the wire connection portion 52, that is, the JB press-connecting terminal 50, is positively positioned at the middle point between the partition walls 63*b* in the width direction of the wire 4 to be press-connected. Therefore, the position of the JB press-connecting terminal 50 in the width direction of the wire 4 can be more positively kept highly precisely.

The retaining piece portions 58, disposed symmetrically with respect to the axis of the wire 4, are arranged in such a manner that the distance between these retaining piece portions 58 is increasing gradually in the direction away from the bottom wall 63*a.* Therefore, when the JB press-connecting terminal 50, attached to the press-connecting plate 60, tends to move in the direction away from the bottom wall 63*a,* the retaining piece portions 58 are positively retained by the inner surfaces 63*c* of the partition walls 63*b.* Therefore, the JB press-connecting terminal 50, received in the wire receiving groove 61, is prevented from moving away from the bottom wall 63*a,* and therefore is prevented from being disengaged from the press-connecting plate 60.

The convex portion 69 projects from the inner surface 63*c* of the partition wall 63*b,* and is formed at the edge portion of the partition wall 63*b* remote from the bottom wall 63*a.* Therefore, when the mounting portion 55*a* is superposed on the bottom wall 63*a,* with each retaining piece portion 58 completely retained by the inner surface 63*c* of the partition wall 63*b,* the retaining piece portion 58 is disposed between the bottom wall 63*a* and the convex portion 69.

Therefore, when the JB press-connecting terminal 50, attached to the press-connecting plate 60, tends to move away from the bottom wall 63*a,* each retaining piece portion 58 strikes against (interferes with) the corresponding convex portion 69. Therefore, the JB press-connecting terminal 50, received in the wire receiving groove 61, is prevented from moving away from the bottom wall 63*a,* and therefore is prevented from being disengaged from the press-connecting plate 60.

The electrical contact portion 52 is received in the receiving portion 64. Therefore, when the JB press-connecting terminal 50 tends to move in the longitudinal direction of the groove main portion 61*a,* the electrical contact portion 52 strikes against (interferes with) the inner surface of the receiving portion 64. Therefore, the JB press-connecting terminal 50, received in the wire receiving groove 61, is prevented from moving in the longitudinal direction of the groove main portion 61*a* to be withdrawn from the wire receiving groove 61, and therefore is prevented from being disengaged from the press-connecting plate 60.

The term "the width direction of the wire 4", used in this specification, means the diametrical direction of the wire 4 which is parallel to the surface of the bottom wall 63*a.* Namely, the two adjacent opposed partition walls 63*b* are spaced from each other in the width direction of the wire 4 which is the same as the width direction of the groove main portion 61*a* of the wire receiving portion 61.

As described above, in the embodiment, the press-connecting terminal is moved toward the bottom wall in the press-connecting direction of the wire to the wire connection portion, and is attached to the plate-like insulating member. Therefore, the press-connecting terminal can be highly precisely positioned in the width direction of the wire.

The retaining portions are retainingly engaged with the plate-like insulating member. The press-connecting direction of the wire to the wire connection portion coincides with the attaching direction of the press-connecting terminal to the plate-like insulating member. Therefore, even when the retaining portions are incompletely retained relative to the plate-like insulating member, the retaining portions can be brought into the completely-retained condition simultaneously when the wire is press-connected to the wire connection portion. Therefore, the plate connector can be assembled without the need for confirming whether or not the retaining portions are completely retained when the press-connecting terminal is attached to the plate-like insulating member. Therefore, the time and labor, required for assembling the plate connector, can be saved.

In the embodiment, when the press-connecting terminal is attached to the plate-like insulating member, each of the retaining piece portions (retaining portions) presses the inner surface of the partition wall of the plate-like insulating member outwardly. Therefore, the wire connection portion, that is, the press-connecting terminal, is positively positioned at the middle point between the partition walls in the width direction of the wire to be press-connected. Therefore, the press-connecting terminal can be positively positioned more precisely in the width direction of the wire.

In the embodiment, the retaining piece portions are arranged in such a manner that the distance between these retaining piece portions is increasing gradually in the direction away from the wall. Therefore, when the press-connecting terminal, attached to the plate-like insulating member, tends to move in the direction away from the wall, the retaining piece portions are positively retained by the inner surfaces of the partition walls.

Therefore, the press-connecting terminal can be highly precisely positioned in the width direction of the wire, and besides the press-connecting terminal, once retained on the inner surfaces of the partition walls through the retaining piece portions, will not be moved away from the wall, and is prevented from being disengaged from the plate-like insulating member.

In the embodiment, there are provided the convex portions which project from the inner surfaces of the two adjacent partition walls, and are remoter from the wall than the retaining piece portions are. Therefore, when the press-connecting terminal, attached to the plate-like insulating member, tends to be withdrawn from the space between the partition walls after the retaining piece portions are completely retained relative to the inner surfaces of the partition walls, each retaining piece portion strikes against (interferes with) the corresponding convex portion.

Therefore, the press-connecting terminal can be highly precisely positioned in the width direction of the wire, and besides the press-connecting terminal, once retained on the inner surfaces of the partition walls through the retaining piece portions, will not be moved away from the wall, and is more positively prevented from being disengaged from the plate-like insulating member.

It is contemplated that numerous modifications may be made to the plate connector of the present invention without departing from the spirit and scope of the invention as defined in the following claims.

What is claimed is:

1. A plate connector, comprising:

a press-connecting terminal including, a) a wire connection portion to which a wire is connectable, and b) an electrical contact portion extending from the wire connection portion, wherein the wire connection pardon and the electrical contact portion are disposed at a position assuming an L-shaped configuration in a main plane of a plate-like insulating member;

an insertion member that is connectable to another metal terminal, wherein the electrical contact portion is adapted to receive the insertion member inserted in an insertion direction;

the plate-like insulating member, which is adapted to receive the press-connecting terminal inserted in the insertion direction, having a wall on which the press-connecting terminal is to be placed; and a retaining portion disposed on the press-connecting terminal, the retaining portion being retained with the plate-like insulating member when the press-connecting terminal is received in the plate-like insulating member, wherein the press-connecting terminal is adapted to receive the wire inserted in the insertion direction.

2. The plate connector of claim 1, wherein the plate-like insulating member includes a plurality of partition walls extending upward from the wall, the retaining portion includes a plurality of retaining piece portions, which respectively project outwardly from a pair of parallel outer surfaces of the wire connection portion, and which are resiliently deformable so that projecting amounts of the retaining piece portions from the outer surfaces of the wire connection portion are varied, and wherein when the press-connecting terminal is attached to the plate-like insulating member so that the press-connecting terminal is inserted between the partition walls adjacent to each other, the retaining piece portions are retainingly engaged, at distal ends thereof disposed remote from the outer surfaces of the wire connection portion, with inner surfaces of the corresponding partition walls, and outwardly presses the inner surfaces of the partition walls by respective resilient restoring forces of the retaining piece portions.

3. The plate connector of claim 2, wherein when the press-connecting terminal is attached to the plate-like insulating member, the retaining piece portions, projecting respectively from the pair of outer surfaces of the wire connection portion, are inclined relative to an attaching direction of the press-connecting terminal to the plate-like insulating member such that a distance between the retaining piece portions is increased gradually in a direction away from the wall of the plate-like insulating member.

4. The plate connector of claim 3, wherein the plate-like insulating member has convex portions projecting from inner surfaces of adjacent two of the partition walls toward each other, and wherein when the press-connecting terminal is attached to the plate-like insulating member, the convex portions are remoter from the wall of the plate-like insulating member than the retaining piece portions are.

5. A plate connector, comprising:

a press-connecting terminal including, a) a wire connection portion to which a wire is connectable, and b) an electrical contact portion extending from the wire connection portion, wherein the wire connection portion and the electrical contact portion are disposed at a position assuming an L-shaped configuration in a plane perpendicular to an insertion direction;

an insertion member that is connectable to another metal terminal, wherein the electrical contact portion is adapted to receive the insertion member inserted in the insertion direction;

a plate-like insulating member, which is adapted to receive the press-connecting terminal inserted in the insertion direction, having a wall on which the press-connecting terminal is to be placed; and a retaining portion disposed on the press-connecting terminal, the retaining portion being retained with the plate-like insulating member when the press-connecting terminal is received in the plate-like insulating member, wherein the press-connecting terminal is adapted to receive the wire inserted in the insertion direction.

6. The plate connector of claim 5, wherein the plate-like insulating member includes a plurality of partition walls extending upward from the wall, the retaining portion includes a plurality of retaining piece portions, which respectively project outwardly from a pair of parallel outer surfaces of the wire connection portion, and which are resiliently deformable so that projecting amounts of the retaining piece portions from the outer surfaces of the wire connection portion are varied, and wherein when the press-connecting terminal is attached to the place-like insulating member so that the press-connecting terminal is inserted between the partition walls adjacent to each other, the retaining piece portions are retainingly engaged, at distal ends thereof disposed remote from the outer surfaces of the wire connection portion, with inner surfaces of the corresponding partition walls, and outwardly presses the inner surfaces of the partition walls by respective resilient restoring forces of the retaining piece portions.

7. The plate connector of claim 6, wherein when the press-connecting terminal is attached to the plate-like insulating member, the retaining piece portions, projecting respectively from the pair of outer surfaces of the wire connection portion, are inclined relative to an attaching direction of the press-connecting terminal to the plate-like insulating member such that a distance between the retaining piece portions is increased gradually in a direction away from the wall of the plate-like insulating member.

8. The plate connector of claim 7, wherein the plate-like insulating member has convex portions projecting from inner surfaces of adjacent two of the partition walls toward each other, and wherein when the press-connecting terminal is attached to the plate-like insulating member, the convex portions are remoter from the wall of the plate-like insulating member than the retaining piece portions are.

* * * * *